United States Patent [19]

Rosenthal

[11] Patent Number: 4,572,289

[45] Date of Patent: Feb. 25, 1986

[54] ELECTRIC WIRELINE PACKER RETRIEVER APPARATUS

[75] Inventor: Wayne O. Rosenthal, Fort Worth, Tex.

[73] Assignee: Pengo Industries, Inc., Fort Worth, Tex.

[21] Appl. No.: 668,099

[22] Filed: Nov. 5, 1984

[51] Int. Cl.[4] ..... E21B 23/00

[52] U.S. Cl. ..... 166/123; 166/181

[58] Field of Search ..... 166/123, 124, 125, 181, 166/182

[56] References Cited

U.S. PATENT DOCUMENTS

| | | | |
|---|---|---|---|
| 3,631,925 | 1/1972 | Nutter | 166/123 |
| 3,678,998 | 7/1972 | Cockrell et al. | 166/123 |
| 4,049,055 | 9/1973 | Brown | 166/123 |
| 4,437,516 | 3/1984 | Cockrell | 166/123 |

*Primary Examiner*—Stephen J. Novosad
*Assistant Examiner*—William P. Neuder
*Attorney, Agent, or Firm*—Wm. T. Wofford; James C. Fails; Arthur F. Zobal

[57] ABSTRACT

In the field of well drilling, completion and production in the petroleum industry a particular type of retrievable packer is commonly set by the application of "pull-push" force which may be derived from a conventional electric wireline setting tool of the pressurized type. The present invention provides a packer retrieving tool that is capable of effective use in retrieving the above-mentioned type packer through use of "pull-push" forces derived from a conventional electric wireline setting tool. The retrieving tool of the present invention additionally includes effective provisions to be utilized in the event of malfunction of the electric wireline setting tool.

16 Claims, 13 Drawing Figures

ELECTRIC WIRELINE PACKER RETRIEVER APPARATUS

FIELD OF INVENTION

The invention relates generally to the field of well drilling, completion and production in the petroleum industry. More specifically, the invention relates to apparatus for retrieving retrievable type packers that have been set in a well bore.

BACKGROUND OF THE INVENTION

Retrievable packers of various types are well known in the applicable prior art. The present invention is concerned with the retrieval of a particular type of retrievable packer, which is a type that is commonly set with the use of an electric wireline setting tool that is pressurized to exert a pulling force on the packer inner mandrel body and a simultaneous pushing force on the packer outer extension sleeve and associated parts, so that the packer slips are moved outwardly and the packing elements are compressed.

This type of packer has conventionally been retrieved with the use of a retrieving tool that is run into the well on a tubing string and is manipulated by the tubing string to achieve packer release and retrieval. Considerable time and effort is required to run a tubing string into and out of a well due to the necessity of coupling each tubing section as the retrieving tool is being run into the well and then uncoupling each tubing section as the retrieving tool is being run out of the well.

It would be advantageous to be able to retrieve the packer with the use of a retrieving tool that is run into and out of the well on an electric wireline and is powered by the same type of electric wireline setting tool that is conventionally used to set the packer. This has not been accomplished in the prior art of which I am aware.

Prior U.S. Pat. No. 3,678,998 Cockrell et al suggests the retrieving of a retrievable packer through use of a wireline running string (col. 1, lines 58–61). However, the retrievable packer is not of the type hereinabove mentioned; an electric wireline setting tool is not used; and manipulation of the wireline (which must be a sandline instead of an electric wireline) is required.

Prior U.S. Pat. No. 3,667,543 Dean suggests the retrieving of a retrievable packer through use of an electric wireline, piano wireline, or sandline (col. 1, lines 38–42). However, the retrievable packer is not of the type hereinabove mentioned; an electric wireline setting tool is not used; and manipulation (upward pull) of the wireline is required.

Prior U.S. Pat. No. 3,542,128 A. L. Owen discloses a retrievable packer that is designed to be retrieved through use of an electric wireline, and prior U.S. Pat. No. 3,503,444 A. L. Owen discloses an electric wireline setting and retrieving tool that is particularly suitable for use with the packer of U.S. Pat. No. 3,542,128 and which setting and retrieving tool is powered by a reversible electric motor. However, the A. L. Owen packer is not of the type hereinabove mentioned and an electric wireline setting tool of the hereinabove mentioned pressurized type is not used.

The objective of the present invention is to provide advantageous apparatus for retrieving retrievable packers of the type hereinabove mentioned through use of a pressurized type electric wireline setting tool hereinabove mentioned. A further objective of the present invention is that the said advantageous apparatus shall include effective provisions to be utilized in the event of malfunction of the electric wireline setting tool.

DESCRIPTION OF THE PREFERRED EMBODIMENTS

Figure 1A:
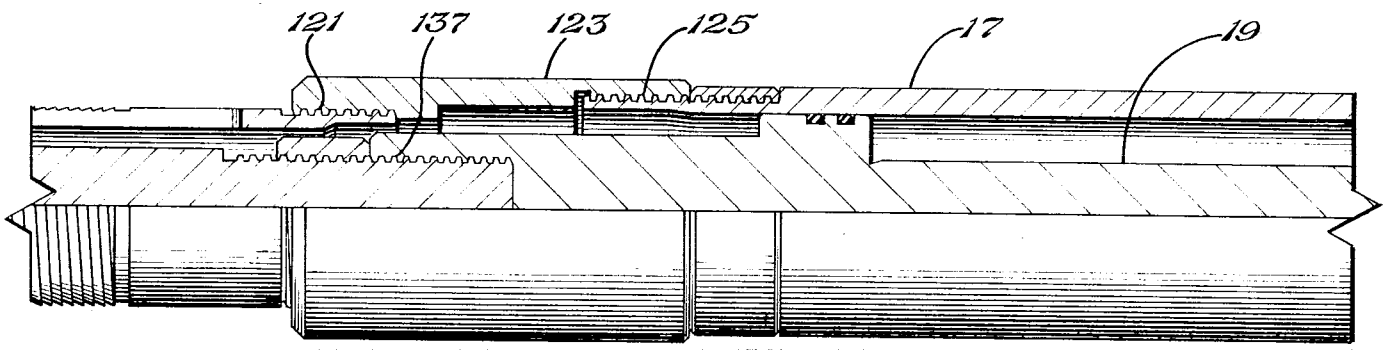
FIGS. 1A, 2A, 3A and 4A are fragmentary longitudinal quarter-sectional views, which taken together and in order show a portion of a setting tool, a retrieving tool in accordance with a preferred embodiment of the invention, and a packer, with the packer in the set condition and the retrieving tool having been set down on the packer, and the setting tool in its running in condition.
Figure 1B:
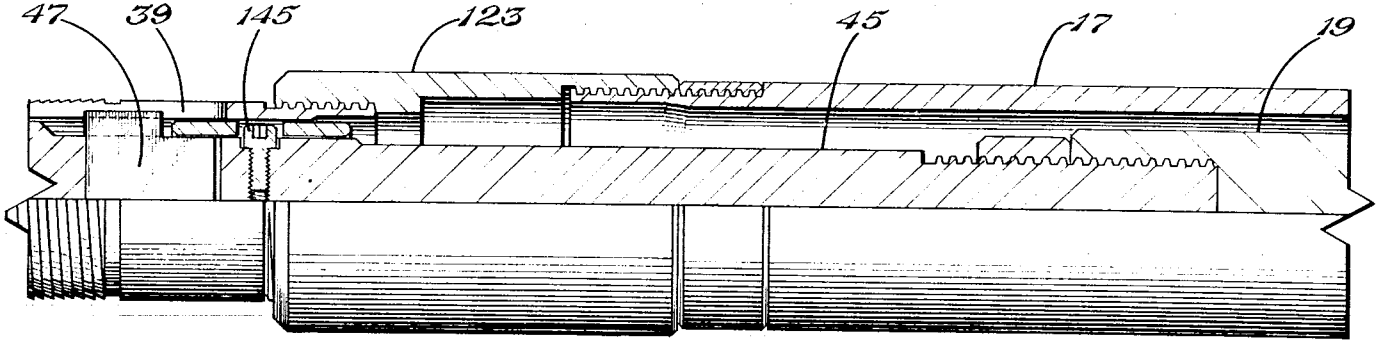
FIGS. 1B, 2B, 3B and 4B correspond with FIGS. 1A, 2A, 3A and 4A, but showing conditions as they exist after the setting tool has been actuated.
Figure 2A:
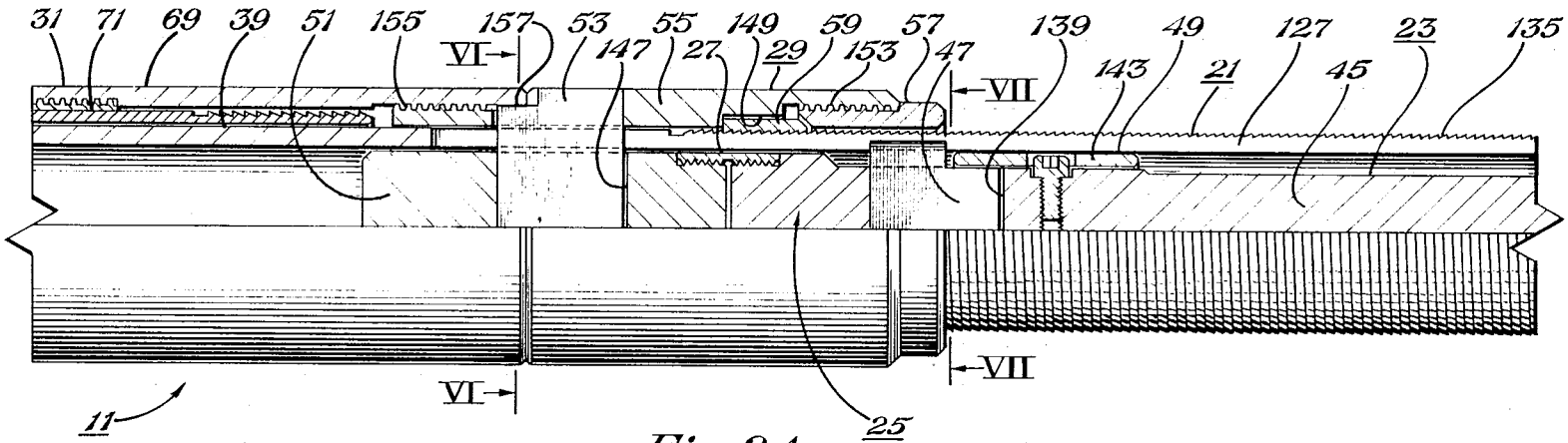
Figure 2B:
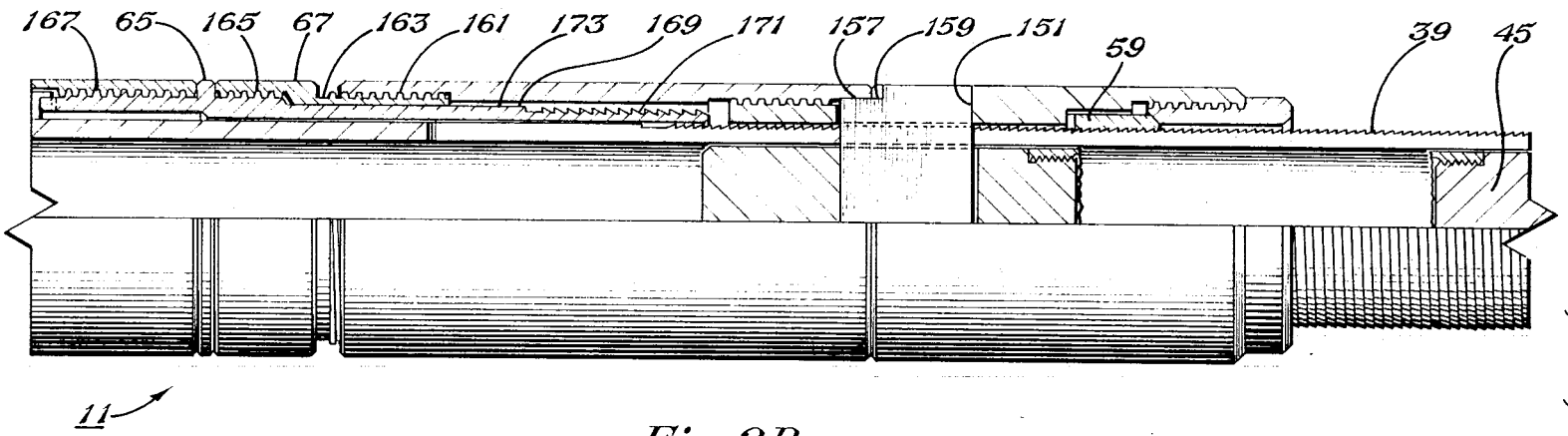
Figure 3A:
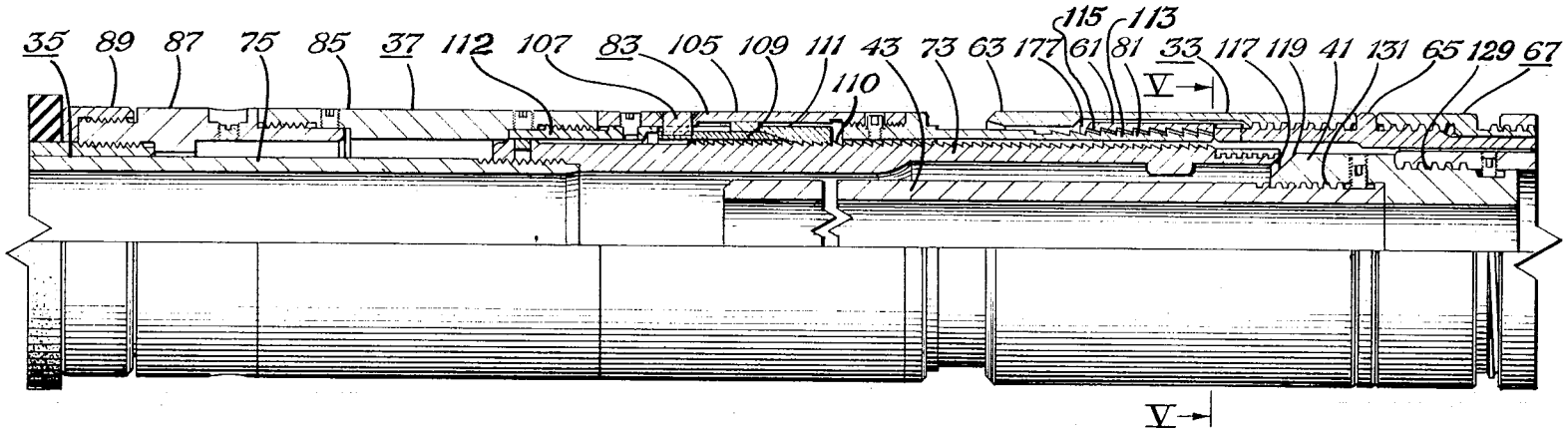
Figure 3B:
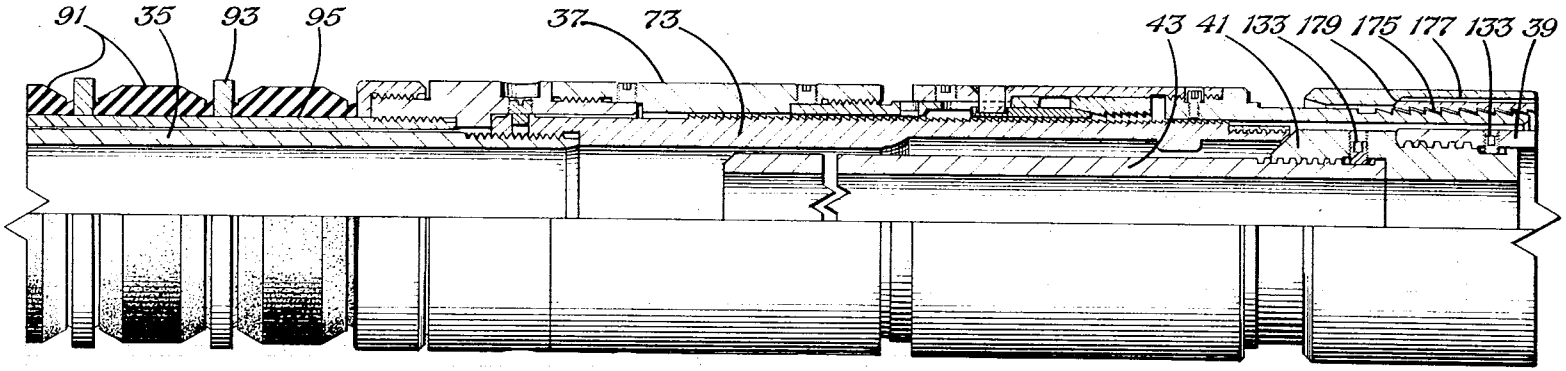
Figure 4A:
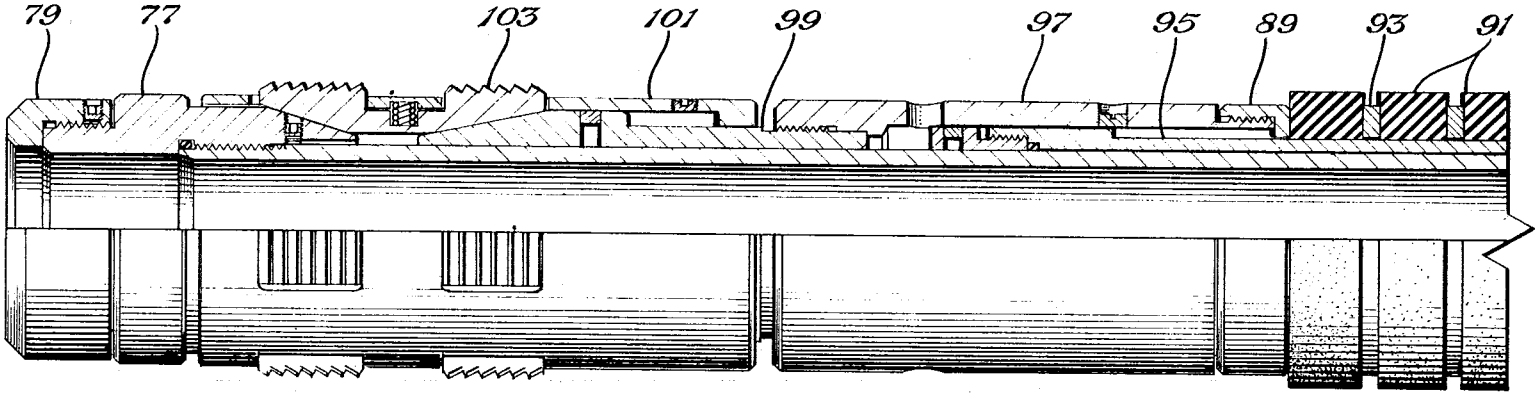
Figure 4B:
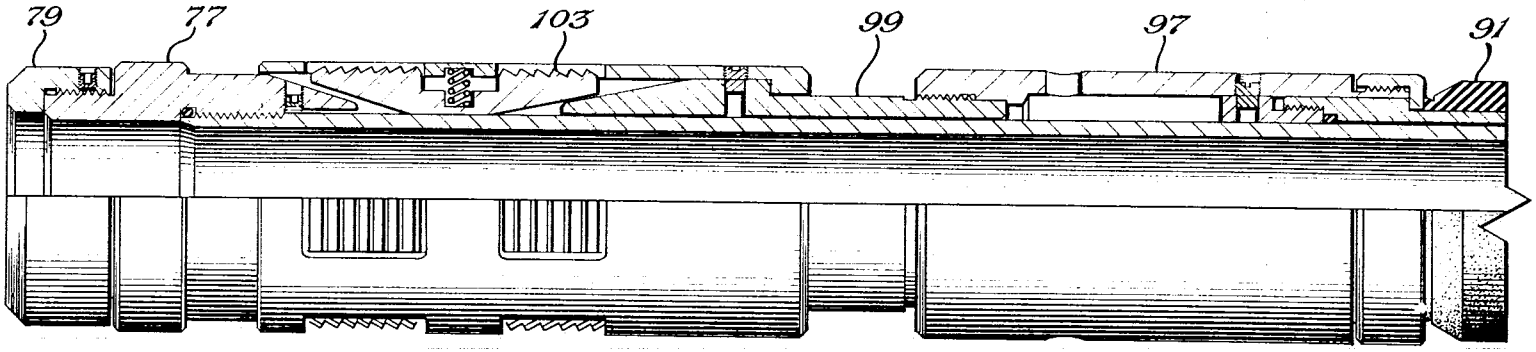
Figure 5:
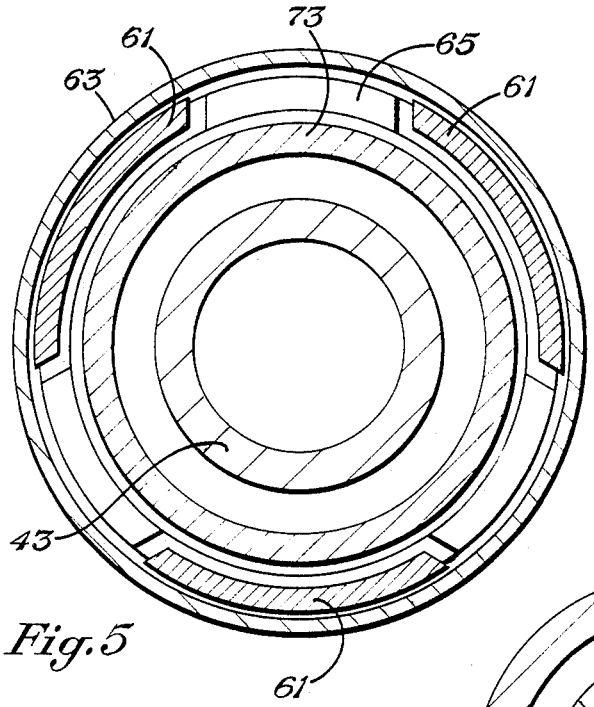
FIG. 5 is a transverse section view taken along lines V—V of FIG. 3A.
Figure 7:
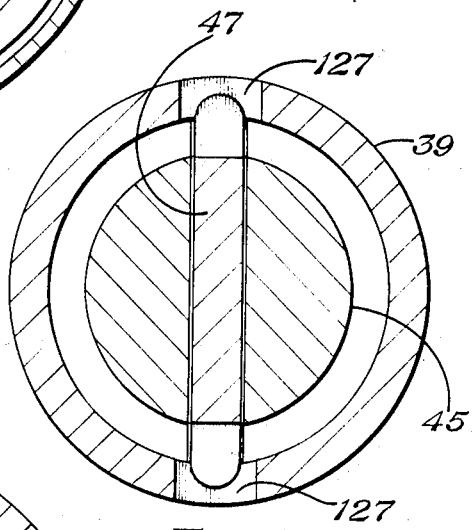
FIG. 7 is a transverse section view taken along lines VII—VII of FIG. 2A.
Figure 6:
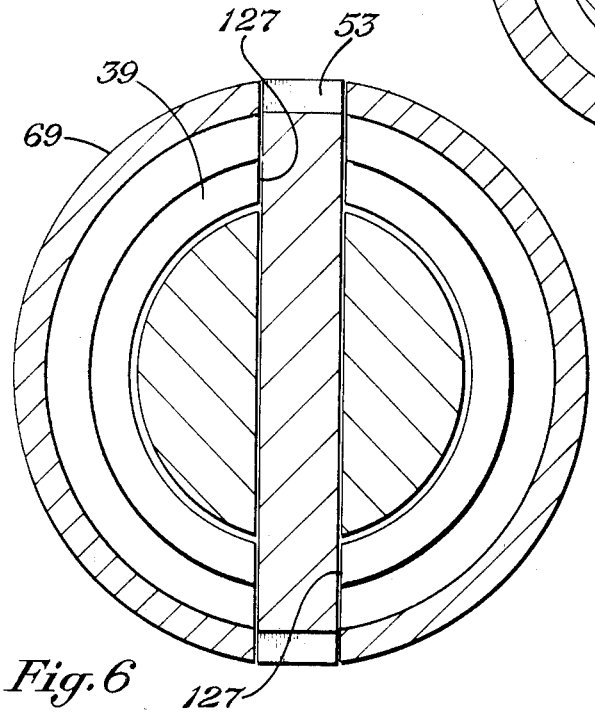
FIG. 6 is a transverse section view taken along lines VI—VI of FIG. 2A.

The present invention provides a packer retrieving tool for use in retrieving a retrievable packer of a type that is set by the application of "pull-push" force which may be derived from a conventional electric wireline setting tool of the pressurized type. The packer retrieving tool of the present invention is used with and is powered by the same type of electric wireline setting tool that is commonly used to set the packer. The packer retrieving tool of the present invention includes effective provisions to be utilized in the event of malfunction of the electric wireline setting tool.

In the drawings there is shown a packer retrieving tool 11 in accordance with a preferred embodiment of the invention, together with a lower end portion of a suitable electric wireline setting tool 13 of the pressurized type, and a retrievable packer 15 of the type that is commonly set with the use of an electric wireline setting tool that is pressurized to exert a pulling force on the packer inner mandrel body and a simultaneous pushing force on the packer outer extension sleeve and associated parts, so that the packer slips are moved outwardly and the packing elements are compressed. As used herein the term "pull-push" force means a force that acts upwardly to "pull" on the retrieving tool tension mandrel assembly and acts downwardly to "push" on the retrieving tool support sleeve assembly.

An electric wireline setting tool of the pressurized type referred to herein is shown by U.S. Pat. No. 3,186,485 H. D. Owen, the disclosure of which is incorporated herein by reference. The drawings are best understood when Sheets 1–4 are placed in order end to end and viewed with Sheet 1 at the right end and Sheet 4 at the left end, in which case the right end represents the upper end of the assembly and the left end represents the lower end of the assembly. The description herein assumes such drawing placement and viewing. FIGS. 1A, 2A, 3A and 4A show the assembly with the retrievable packer 15 in the "set" condition (casing is not shown) with the retrieving tool 11, setting tool 13 assembly having been "run in" on a wireline and "set down" onto the packer retrieving neck. FIGS. 1B, 2B, 3B and 4B show the assembly after the setting tool 13 has been actuated and has achieved its full stroke and the retrieving tool 11 has acted so that the packer 15 has been unlatched and stretched to its original running in condition so that its packing elements have relaxed and moved inwardly and the slips have retracted.

Referring particularly to FIGS. 1A–4A there is shown in order from top to bottom the lower end portion of setting tool 13, packer retrieving tool 11 and retrievable packer 15. The lower portion of setting tool 13 shown includes the lower end portions of the setting tool cylinder 17 and setting tool piston 19. The packer retrieving tool 11 includes a support sleeve assembly 21, a tension mandrel assembly 23, a cross link mandrel assembly 25, tension release means 27, a ratchet lock assembly 29, and a retrieving grapple assembly 33. The retrievable packer 15 includes a mandrel body and associated parts 35, and a retrieving neck and associated parts 37.

The support sleeve assembly 21 includes a support sleeve 39, a centering shoe 41 and a tail pipe 43. The tension mandrel assembly 23 includes a tension mandrel 45, torque link means 47, and torque link retainer means 49. The cross link mandrel assembly 25 includes a cross link mandrel 51, and cross link means 53. The ratchet lock assembly 29 includes ratchet lock housing means made up of a ratchet lock housing 55 and a lock ring backup member 57, and ratchet lock means 59. The retrieving grapple assembly includes a retrieving grapple to ratchet lock assembly connecting means 31, grapple ring means 61, and grapple ring housing means 63. The retrieving grapple assembly to ratchet lock assembly connecting means 31 may include coupling sleeve means 65, safety release means 67, and connector sleeve means 69. The coupling sleeve means 65 may incorporate a secondary fishing neck 71.

The retrievable packer mandrel body and associated parts 35 include a latch receiver means 73, a mandrel body means 75, bottom cone means 77 and a thread protector 79. The retrievable packer retrieving neck and associated parts 35 includes a retrieving neck means 81, a releasing crossover assembly 83, an extension sleeve 85, a quick release sub 87, gage rings 89, packing elements 91, spacers 93, a packing mandrel 95, a pickup sleeve means 97, a top cone means 99, a slip housing means 101, and slip segments 103. The releasing crossover assembly 83 includes a crossover sleeve means 105, crossover pins 107, a ratchet lock pawl 109, a lock ring 111 and lock ring backup means 112.

The retrievable packer 15 is of a well known type, shown and described herein only to aid in the understanding of the packer retrieving tool 11 of the present invention. Consequently the retrievable packer 15 will not be described in detail and a brief description will suffice. The retrieving neck means 81 is normally provided with buttress type left hand threads 113 that mate with similar threads 115 on the grapple ring means 61, in such manner that when the mating threads 113, 115 are engaged and the setting tool 13 is actuated, a "pull" force is exerted on the retrieving neck and associated parts 37. The upper end of the packer latch receiver means 73 has a bearing surface 117 which is adapted for engaging a lower surface 119 of the centering shoe 41, in such manner that when the setting tool 13 is actuated a "push" force is exerted on the packer mandrel body and associated parts 35. When the packer 15 is set the lock ring 111 is in locked engagement with ratcheting means in the form of buttress type threads 110 that permit one way ratcheting downwardly.

The retrieving tool 11 of the present invention will now be described in further detail. The support sleeve 39 has the general configuration of a cylindrical tube, having attachment means 121 such as external threads at its upper end portion which is adapted for connection to an adapter sleeve 123 which in turn is connected by threads 125 to the lower end portion of the setting tool cylinder 17. The support sleeve 39 is provided radially disposed slot means 127 extending longitudinally thereof below the attachment means 121. In the embodiment shown the slot means 127 is made up of two slots that are 180° apart. The slot means 127 is of length sufficient to accomodate the movement of the torque link means 47 and the cross link means 53 that occurs when the setting tool 13 has been actuated and has achieved its full stroke. The centering shoe 41 has the general configuration of a cylindrical tube and in the embodiment shown has external threads 129 at its upper end portion that are adapted for engagement and mating with internal threads at the lower end portion of the support sleeve 39, and internal threads 131 at its lower end portion that are adapted for engagement and mating with external threads at the upper end portion of the tail pipe 43. The tail pipe 43 has the general configuration of a cylindrical tube and is adapted to extend interiorly of the packer latch receiver 73. The centering shoe 41 and the tail pipe 43 are retained by suitable set screws 133. The support sleeve 39 is provided with ratchet means 135 on its exterior surface which extend longitudinally thereof between the longitudinal extremities of the slot means 127. In the embodiment shown the ratchet means 135 are buttress type threads disposed to permit one way ratcheting in the upward direction.

Figure 8:
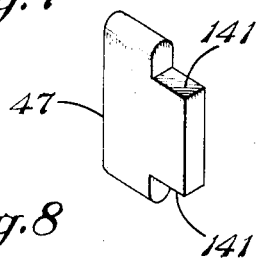
FIG. 8 is a schematic perspective view showing a retrieving tool torque link.

The tension mandrel 45 has the general configuration of a cylindrical bar and is disposed within support sleeve 39, and has attachment means 137 such as external threads at its upper end portion which is adapted for connection to the lower end portion of the setting tool piston 19. The tension mandrel 45 has radially disposed slot means 139 near its lower end portion for receiving torque link means 47. In the embodiment shown the slot means is a single slot 139 extending through the tension mandrel 45 in a plane that contains the tension mandrel diameter. The slot 139 is dimensioned to matingly receive the width and thickness of the torque link means 47 which in the embodiment shown is a single torque link 47 as best seen in FIG. 8. The torque link 47 extends radially outwardly of the tension mandrel at both of its end portions so as to be engageable with the support sleeve slot means 127. The torque link 47 has oppositely disposed shoulder portions 141 on its upper end portion such that the distance between them is substantially equal to the adjacent tension mandrel diameter. A torque link retainer sleeve 143 is matingly received by the tension mandrel 45 immediately above the slot 139 and is retained thereon by means of suitable means such as retainer screws 145. The retainer sleeve 143 extends downwardly so as to capture the shoulder portions 141 of the torque link 47.

The tension release means 27 in the embodiment shown is an internally threaded sleeve having a weak portion provided by an internal circumferential slot at its mid-portion. The tension release means 27 releasably attaches the tension mandrel 45 to the cross link mandrel 51 by means of respective threaded portions at the lower end portion of the tension mandrel 45 and the upper end portion of the cross link mandrel 51.

Figure 9:
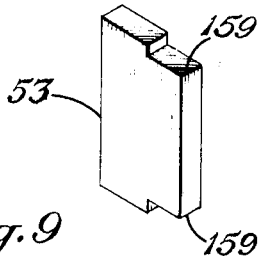
FIG. 9 is a schematic perspective view showing a retrieving tool cross link.

The cross link mandrel 51 has the general configuration of a cylindrical bar and is disposed within support sleeve 39 and with its upper end portion adjacent the lower end of the tension mandrel 45 and attached to the tension release means 27. The cross link mandrel 51 has radially disposed slot means 147 intermediate its length for receiving cross link means 53. In the embodiment shown the slot means is a single slot 147 extending through the cross link mandrel 51 in a plane that contains the cross link mandrel diameter. The slot 147 is dimensioned to matingly receive the width and thickness of the cross link means 53 which in the embodiment shown is a single cross link 53 as best seen in FIG. 9.

The ratchet lock means 59 in the embodiment shown is a split cylindrical sleeve 59 having internal buttress type threads that are matingly received by the buttress type threads of the support sleeve ratchet means 135. The ratchet lock housing 55 has the general configuration of a cylindrical tube having exterior and interior generally cylindrical surfaces, with its interior cylindrical surfaces being disposed outwardly of and adjacent to the exterior surfaces of the support sleeve 39. The ratchet lock housing has internally disposed threads 153 at its upper end portion which matingly engage exteriorly disposed threads at the lower end portion of the lock ring backup member 57. The lock ring backup member has the general configuration of a cylindrical sleeve having an interior cylindrical surface disposed outwardly of and adjacent to the exterior surfaces of the support sleeve 39. The ratchet lock housing 55 and the lock ring backup member 57 together form a cavity 149 for receiving the ratchet lock means 59, with the cavity 149 including a first surface for abutting the ratchet lock means lower end surface so as to cause the ratchet lock means 59 to ratchet upwardly on the support sleeve ratchet means 135, and a second surface for abutting the ratchet lock means upper end surface so as to lock the ratchet lock means 59 against movement downwardly on the support sleeve ratchet means 135. In the embodiment shown the ratchet lock means upper end surface and the cooperating cavity second surface both have a downward taper relative to their respective inner diameter. The ratchet lock housing 55 has radially disposed ratchet lock housing slot means 151 near its lower end portion for receiving cross link means 53. In the embodiment shown the slot means 151 is made up of two slots that are 180° apart. The slots 151 are dimensioned to matingly receive the width and thickness of the cross link 53. The ratchet lock housing further has external threads 155 at its lower end portion.

The connector sleeve means 69 in the embodiment shown has the general configuration of a cylindrical tube having exterior and interior generally cylindrical surfaces and having internal threads at both of its end portions, but with the upper end portion extending upwardly beyond the threads to form a cylindrical recess 157. The cross link 53 extends at both of its end portions radially outwardly of the cross link mandrel 51 and through the support sleeve slot means 127 and into the ratchet housing slot means 151. The length of the cross link 53 is substantially equal to the diameters of the connector sleeve means 69 and the ratchet lock housing 55. The cross link 53 has oppositely disposed shoulder portions 159 on its lower end portion such that the distance between them is substantially equal to the diameter of the cylindrical recess 157. The shoulder portions 159 of the cross link 53 extend downwardly into the cylindrical recess 157 and is thereby retained.

The safety release means 67 in the embodiment shown has the general configuration of a cylindrical tube having an internal cylindrical surface, having external threads 161 at its upper end portion adapted for matingly engaging with the internal threads at the lower end portion of the connector means sleeve 69, having internal threads at its lower end portion, and having a weak web portion 163 immediately below the external threads.

The coupling sleeve means 65 in the embodiment shown has the general configuration of a cylindrical tube, having upper external threads 165 and lower external threads 167, having a secondary fishing neck portion 169 extending upwardly beyond the upper external threads 165, and having a generally cylindrical internal surface. The secondary fishing neck portion 169 has at its upper end portion ratchet means 171 in the form of buttress type threads adapted for engagement with a retrieving or fishing tool for ratcheting one way downwardly. The secondary fishing neck portion 169 further has a cylindrical exterior surface 173 extending between the upper end of the upper external threads 165 and the lower end of the ratchet means 171. The internal cylindrical surface of the safety release means 67 is matingly received by the cylindrical exterior surface 173 of the secondary fishing neck portion 169. The coupling sleeve means 65 has at its lower end portion beneath the lower external threads 167 torqueing engagement means, which in the embodiment shown is a tongue and groove configuration.

The grapple ring means 61 in the embodiment shown is a split cylindrical sleeve 61, having internal buttress type threads 175 that are matingly received by the buttress type threads of the packer retrieving neck means 81, having an external cylindrical surface, a lower end surface and an upper end portion. The grapple ring means upper end portion incorporates torqueing engagement means, which in the embodiment shown is a tongue and groove configuration that is matingly received by the tongue and groove configuration at the lower end portion of the coupling sleeve means 65. The internal buttress type threads 175 of the split cylindrical sleeve 61 are adapted for one way ratcheting on the packer retrieving neck means 81 in the downward direction.

The grapple ring housing means 63 in the embodiment shown has the general configuration of a cylindrical sleeve having generally cylindrical interior and exterior surfaces, with a portion of the interior surface forming a cavity 177 for receiving the grapple ring means, with the grapple ring means external cylindrical surface being disposed adjacent a cylindrical interior surface of the cavity 177. The cavity 177 includes a lower surface 179 adapted for abutting the lower end surface of the grapple ring means 61 when the setting tool 13 has been actuated, for locking the grapple ring means 61 against movement upwardly on the packer retrieving neck means 81. In the embodiment shown the cavity lower surface 179 and the cooperating lower end surface of the grapple ring means 61 both have an upward taper relative to their respective inner diameter.

The operation of the packer retrieving tool of the present invention will now be described. The packer retrieving tool 11 is assembled onto the electric wireline setting tool 13 and this assembly together with a suitable collar locator, is run into the well on a wireline and is set down onto the retrievable packer 15. As the retrieving tool 11 is being set down onto the packer 15 the tail pipe 43 enters the interior of the latch receiver 73 and serves as a guide so that the lower end portion of the grapple ring housing means 63 will move downwardly on the packer retrieving neck means 81 and the grapple ring means 61 will be matingly received by the buttress type threads on the retrieving neck means 81 and will ratchet downwardly thereon until the lower extremity of the coupling sleeve means 65 abuts the upper extremity of the packer retrieving neck means 81. It is important to note that the retrieving tool 11 is designed so as to establish a positive relationship between the lower extremities of the coupling sleeve means 65 and the centering shoe 41 when the retrieving tool 11 is assembled onto the electric wireline setting tool 13 for running into the well. This positive relationship places the lower extremity of the centering shoe 41 a predetermined distance above the lower extremity of the coupling sleeve means 65. This predetermined distance is sufficient to assure that there will always be a gap between the lower extremity of the centering shoe 41 and the upper extremity of the packer latch receiver 73 when the retrieving tool 11 is set down onto the packer 15. It will be appreciated that when that packer 15 is set, the upper extremity of the latch receiver 73 will assume a level relative to the upper extremity of the retrieving neck means 81, which level will depend on the inside diameter of the casing in which the packer 15 is set. The abovementioned gap permits the retrieving tool 11 to accomodate a full range of inner diameters for casing in which the packer 15 may be set. FIGS. 1A–4A show the condition that exists after the retrieving tool 11 assembled with the electric wireline setting tool 13 has been run into a well on a wireline and set down onto a retrievable packer 15 that is set and is to be retrieved, but before the setting tool 13 is actuated.

Next an upward pull is exerted on the wireline sufficient to indicate to the operator that the retrieving tool 13 is in fact engaged with and locked onto the packer 15. Next the operator causes the pressure generating material in the setting tool 13 to be ignited, resulting in actuation of the setting tool 13. The generation of pressure within the setting tool results in upward movement of the setting tool piston 19 relative to the setting tool cylinder 17, which results in the application of a "pull" force acting upwardly on the tension mandrel 45 and a "push" force acting downwardly on the support sleeve 39. The "pull" force on the tension mandrel 45 is transmitted via the tension release means 27, cross link mandrel 51, cross link means 53, ratchet lock housing 55, connector sleeve means 69, safety release means 67, coupling sleeve means 65, grapple ring housing means 63 and grapple ring means 61 to the packer retrieving neck and associated parts 37. The support sleeve 39 and centering shoe 41 will move downwardly causing the centering shoe lower surface 119 to contact the bearing surface 117 at the upper extremity of the packer latch receiver 73 at which time the "push" force on the support sleeve 39 will be transmitted via the centering shoe and the packer latch receiver 73 to the packer mandrel body and associated parts 35.

This "pull-push" force applied to the packer 15 via retrieving tool 11 will first cause upward movement of crossover sleeve means 105, which via crossover pins 107 will cause upward movement of the ratchet pawl 109 relative to the latch receiver means 73, lifting lock ring 111 out of its engagement with ratcheting means 110 and thus allowing the packer retrieving neck and associated parts 37 to move upwardly relative to the packer mandrel body and associated parts 35. As this movement progresses, the retrieving tool ratchet lock housing 55 is simultaneously moving upwardly relative to the support sleeve 39 and the retrieving tool ratchet lock means is ratcheting upwardly on the support sleeve ratchet means 135. This relative movement continues until the packer retrieving neck and associated parts 37 has moved to the same position it was in prior to the setting of the packer. Stated another way, the relative movement continues until the packer has been "stretched" to assume its original running in condition. In this condition, of course, the slip segments 103 are retracted and the packer elements 91 have lengthened and moved radially inwardly away from the casing.

After the packer 15 has assumed the "stretched" condition the setting tool 13 continues to apply "pull" force on the tension mandrel 45. At this time the tension mandrel 45 is restrained against further upward movement, causing the tension force to build up until it reaches the magnitude (for example, 30,000 pounds) required to part the tension release means 27.

Immediately after the tension release means 27 has parted the retrieving tool lock ring backup member 57 will move downwardly to engage the tapered upper surface of the ratchet lock means 59 to lock same and thus retain the packer 15 in its "stretched" condition. Also, when the tension release means 27 has parted, the upward movement continues until the setting tool 13 has completed its full stroke. The full stroke of the setting tool 13 may typically be about nine (9) inches, with the maximum gap between the retrieving tool centering shoe lower surface 119 and the packer latch receiver bearing surface 117 being typically about two (2) inches and the relative movement required to move the packer to its "stretched" condition being typically about four (4) inches.

When the operator feels that the setting tool has had time to achieve its full stroke he will attempt to take up some wireline, and if the attempt succeeds, indicating that the packer is free, the operator will then let out wireline to permit the packer, retrieving tool, setting tool assembly to move below the depth where the packer was set. If this is successful, it will further confirm that the packer is free, and the operator may then run the assembly out of the well.

It is important to note that were it not for the provision of a tension release means 27, the setting tool would be applying much force on various parts of the retrieving tool 11 and the packer 15, which force would continue to be applied as the assembly is being run out of the well and even thereafter. This stress on the various parts of the retrieving tool and packer would be highly undesirable from the standpoint of the parts involved and also from the standpoint of the hazards attending dis-assembly.

It will be apparent from the foregoing that the packer retrieving tool 11 of the present invention provides for the effective retrieval of the relevant type retrievable packer through use of the same type of electric wireline setting tool that is conventionally used to set the packer.

The packer retrieving tool 11 of the present invention also incorporates effective provisions to be utilized in the event of malfunction of the electric wireline setting tool, and these will now be discussed.

If for any reason, after the retrieving tool 13 has been engaged with and locked onto the packer 15, the operator is unable to initiate actuation of the setting tool 13, then he will increase tension on the wireline until either the packer 15 is pulled free or the wireline is pulled out of its cable head attachment socket. In the latter case the operator will pull the wireline out of the well and run a conventional tubing overshot device into the well which device will latch onto the cable head fish. Next the operator will apply tension force up to a predetermined maximum (typically about 45,000 pounds), which is not sufficient to part the safety release means 67 but which may be sufficient to free the packer 15.

If the packer 15 is not freed by this tension force, the operator has two choices. One choice is to apply right "hand" torque, which will be transmitted via the setting tool piston 19; tension mandrel 45; either or both of cross link mandrel 25 and cross link means 53 or torque link means 47, support sleeve 39 and cross link means 53, to ratchet lock housing 55 and from there via connector sleeve means 69, safety release means 67 and coupling sleeve means 65 to grapple ring means 61. This right "hand" torque will screw the grapple ring means off the packer retrieving neck means 81 so that the retrieving tool 11 and setting tool 13 assembly can be run out of the well, leaving the packer 15 to be dealt with by other means, such as drilling it out.

The operator's other choice is to apply sufficient tension to the tubing to part the safety release means 67 (typically about 60,000 pounds), after which the retrieving tool 11 with the exception of the coupling sleeve means and the grapple ring means housing 63 and the grapple ring means 61, and the setting tool 13 are run out of the well. The parting of the safety release means will expose the secondary fishing neck 71 so that suitable conventional means can be run into the well on tubing and latched onto the secondary fishing neck, and tension force greatly in excess of that required to part the safety release means 67 can now be applied.

It will be apparent from the foregoing that the packer retrieving tool 11 of the present invention incorporates effective provisions that can be utilized in the event of malfunction of the electric wireline setting tool 13.

The foregoing disclosure and the showings made in the drawings are merely illustrative of the principles of this invention and are not to be interpreted in a limiting sense.

I claim:

1. A packer retrieving tool for use in retrieving a retrievable packer of a type that is set by the application of "pull-push" force which may be derived from a conventional electric wireline setting tool of the pressurized type comprising:

a. a support sleeve assembly having the general configuration of a cylindrical tube having exterior and interior generally cylindrical surfaces and including support sleeve means and centering shoe means, with said support sleeve means comprising:
   i. attachment means at its upper end portion adapted for attachment to a conventional electric wireline setting tool of the pressurized type so as to transmit "push" force to said support sleeve means when the setting tool is actuated;
   ii. radially disposed support sleeve slot means extending longitudinally of said support sleeve means below said attachment means;
   iii. ratchet means on the exterior surface of said support sleeve means and extending longitudinally of said support sleeve means between the longitudinal extremities of said slot means;

and with said centering shoe means being disposed at the lower end portion of said support sleeve assembly and having a lower surface disposed for engaging an upper surface of said packer so as to exert a "push" force on the packer mandrel body when said setting tool is actuated;

b. a tension mandrel assembly comprising:
   i. a tension mandrel having the general configuration of a cylindrical bar and disposed within said support sleeve means; having attachment means at its upper end portion adapted for attachment to a conventional electric wireline setting tool of the pressurized type so as to receive "pull" force when the setting tool is actuated; having tension mandrel radially disposed slot means near its lower end portion for receiving torque link means;
   ii. torque link means disposed in said tension mandrel radially disposed slot means and extending radially outwardly of said tension mandrel for engaging said support sleeve slot means;

c. A cross link mandrel assembly comprising:
   i. a cross link mandrel having the general configuration of a cylindrical bar and disposed within said support sleeve means and with its upper end portion adjacent the lower end of said tension mandrel; having cross link mandrel radially disposed slot means intermediate its length for receiving cross link means;
   ii. cross link means disposed in said cross link mandrel radially disposed slot means;

d. tension release means adapted for releasably attaching said tension mandrel assembly to said cross link mandrel assembly;

e. a ratchet lock assembly comprising:
   i. ratchet lock means for engaging said ratchet means on the exterior surface of said support sleeve means and having lower and upper end surface portions;
   ii. ratchet lock housing means having the general configuration of a cylindrical tube having exterior and interior generally cylindrical surfaces; with said interior cylindrical surfaces being disposed outwardly of and adjacent to the exterior surfaces of said support sleeve assembly with a portion of said interior surfaces forming a cavity for receiving said ratchet lock means, including a surface for abutting said ratchet lock means lower end surface portion and urging said ratchet lock means to ratchet upwardly on said support sleeve ratchet means, and including a surface for abutting said ratchet lock means upper end surface portion to lock said ratchet lock means against movement downwardly on said support sleeve ratchet means; radially disposed ratchet lock housing slot means located beneath said ratchet lock means for receiving said cross link means, with said cross link means extending outwardly of said tension mandrel and through and beyond said support sleeve slot means so as to transmit said "pull" force from said tension mandrel to said ratchet lock means housing; attachment means at the lower end portion of said ratchet lock means housing adapted for attachment to the upper end portion of a connector sleeve;

f. said connector sleeve having the general configuration of a cylindrical tube having exterior and interior generally cylindrical surfaces; having upper attachment means adapted for attachment to the lower end portion of said ratchet lock assembly; and having lower attachment means adapted for attachment to the upper end portion of a retrieving grapple assembly;

g. said retrieving grapple assembly including safety release means, coupling sleeve means, grapple ring means and grapple ring housing means;

i. said safety release means having the general configuration of a cylindrical tube with upper attachment means adapted for attachment to the lower attachment means of said connector sleeve; with lower attachment means adapted for attachment to the upper end portion of said coupling sleeve means; with a weak portion disposed between said upper and lower attachment means;

ii. said coupling sleeve means having upper attachment means adapted for attachment to said safety release means lower attachment means; having lower attachment means adapted for attachment to upper attachment means of said grapple ring housing means; having a secondary fishing neck portion extending upwardly beyond said coupling sleeve means upper attachment means and disposed between the interior surface of said connector sleeve and the exterior surface of said support sleeve; and having torqueing engagement means at its lower end portion adapted to engage torqueing engagement means disposed at the upper end portion of said grapple ring means;

iii. said grapple ring means having the general configuration of a split cylindrical sleeve having generally cylindrical interior and exterior surfaces and upper and lower end portions; having ratchet means on said interior surface adapted for engaging and ratcheting downwardly on the retrieving neck of a packer to be retrieved; and having torqueing engagement means at its upper end portion adapted for engagement with said coupling sleeve torqueing engagement means to disengage said retrieving grapple assembly from said packer retrieving neck responsive to torqueing of said grapple ring means;

iv. said grapple ring housing means having the general configuration of a cylindrical sleeve having generally cylindrical interior and exterior surfaces; with a portion of said interior surface forming a cavity for receiving said grapple ring means, including a lower surface for abutting said grapple ring means lower end portion to lock said grapple ring means against movement upwardly on said packer retrieving neck.

2. The apparatus of claim 1 wherein means are provided to assure that there is a gap between the lower surface of said centering shoe means and said upper end surface of said packer initially when said packer retrieving tool is set down on said packer and prior to actuation of said setting tool, so as to accomodate a range of inner diameters for casing in which said packer is set.

3. The apparatus of claim 1 wherein said grapple ring means ratchet means includes threads of "hand" opposite to that of other threads on said packer retrieving tool that are subject to said torqueing action.

4. The apparatus of claim 2 wherein said grapple ring means ratchet means includes threads of "hand" opposite to that of other threads on said packer retrieving tool that are subject to said torqueing action.

5. A packer retrieving tool for use in retrieving a retrievable packer of a type that is set by the application of "pull-push" force which may be derived from a conventional electric wireline setting tool of the pressurized type comprising:

a. a support sleeve assembly having the general configuration of a cylindrical tube having exterior and interior generally cylindrical surfaces and including support sleeve means and centering shoe means, with said support sleeve means comprising:

i. attachment means at its upper end portion adapted for attachment to a conventional electric wireline setting tool of the pressurized type so as to transmit "push" force to said support sleeve means when the setting tool is actuated;

ii. radially disposed support sleeve slot means extending longitudinally of said support sleeve means below said attachment means;

iii. ratchet means on the exterior surface of said support sleeve means and extending longitudinally of said support sleeve means between the longitudinal extremities of said slot means;

and with said centering shoe means being disposed at the lower end portion of said support sleeve assembly and having a lower surface disposed for engaging an upper surface of said packer so as to exert a "push" force on the packer mandrel body when said setting tool is actuated;

b. a tension mandrel assembly comprising:

i. a tension mandrel having the general configuration of a cylindrical bar and disposed within said support sleeve means; having attachment means at its upper end portion adapted for attachment to a conventional electric wireline setting tool of the pressurized type so as to receive "pull" force when the setting tool is actuated; having tension mandrel radially disposed slot means near its lower end portion for receiving torque link means;

ii. torque link means disposed in said tension mandrel radially disposed slot means and extending radially outwardly of said tension mandrel for engaging said support sleeve slot means;

c. A cross link mandrel assembly comprising:

i. a cross link mandrel having the general configuration of a cylindrical bar and disposed within said support sleeve means and with its upper end portion adjacent the lower end of said tension mandrel; having cross link mandrel radially disposed slot means intermediate its length for receiving cross link means;

ii. cross link means disposed in said cross link mandrel radially disposed slot means;

d. tension release means adapted for releasably attaching said tension mandrel assembly to said cross link mandrel assembly;

e. a ratchet lock assembly comprising:

i. ratchet lock means for engaging said ratchet means on the exterior surface of said support sleeve means and having lower and upper end surface portions;

ii. ratchet lock housing means having the general configuration of a cylindrical tube having exterior and interior generally cylindrical surfaces; with said interior cylindrical surfaces being disposed outwardly of and adjacent to the exterior surfaces of said support sleeve assembly with a portion of said interior surfaces forming a cavity for receiving said ratchet lock means, including a surface for abutting said ratchet lock means lower end surface portion and urging said ratchet lock means to ratchet upwardly on said support sleeve ratchet means, and including a surface for abutting said ratchet lock means upper end surface portion to lock said ratchet lock means against movement downwardly on said support sleeve ratchet means; radially disposed ratchet lock housing slot means located beneath said ratchet lock means for receiving said cross link means, with said cross link means extending outwardly of said tension mandrel and through and beyond said support sleeve slot means so as to transmit said "pull" force from said tension mandrel to said ratchet lock means housing; attachment means at the lower end portion of said ratchet lock means housing adapted for attachment to the upper end portion of said retrieving grapple assembly;

f. said retrieving grapple assembly including grapple ring means and grapple ring housing means;

i. said attachment means at the lower end of said ratchet lock means housing having torqueing engagement means adapted to engage torqueing engagement means disposed at the upper end portion of said grapple ring means;

ii said grapple ring means having the general configuration of a split cylindrical sleeve having generally cylindrical interior and exterior surfaces and upper and lower end portions; having ratchet means on said interior surface adapted for engaging and ratcheting downwardly on the retrieving neck of a packer to be retrieved; and having torqueing engagement means at its upper end portion adapted for engagement with said coupling sleeve torqueing engagement means;

iii. said grapple ring housing means having the general configuration of a cylindrical sleeve having generally cylindrical interior and exterior surfaces; with a portion of said interior surface forming a cavity for receiving said grapple ring means, including a lower surface for abutting said grapple ring means lower end portion to lock said grapple ring means against movement upwardly on said packer retrieving neck.

6. The apparatus of claim 5 wherein means are provided to assure that there is a gap between the lower surface of said centering shoe means and said upper end surface of said packer initially when said packer retrieving tool is set down on said packer and prior to actuation of said setting tool, so as to accomodate a range of inner diameters for casing in which said packer is set.

7. The apparatus of claim 6 wherein said grapple ring means ratchet means includes threads of "hand" opposite to that of other threads on said packer retrieving tool that are subject to said torqueing action.

8. The apparatus of claim 5 wherein said grapple ring means ratchet means includes threads of "hand" opposite to that of other threads on said packer retrieving tool that are subject to said torqueing action.

9. A packer retrieving tool for use in retrieving a retrievable packer of a type that is set by the application of "pull-push" force which may be derived from a conventional electric wireline setting tool of the pressurized type comprising:

a. a support sleeve assembly adapted for attachment of its upper end portion to a conventional electric wireline setting tool of the pressurized type so as to transmit "push" force to the support sleeve assembly when the setting tool is actuated; having centering shoe means at its lower end adapted for bearing on an upper end surface of said packer so as to exert said "push" force on the packer mandrel body;

b. a tension mandrel assembly disposed within said support sleeve assembly and adapted for attachment at its upper end to said setting tool so as to transmit "pull" force to the tension mandrel assembly when said setting tool is actuated;

c. a cross link mandrel assembly disposed within said support sleeve assembly beneath and adjacent said tension mandrel assembly and releasably attached to said tension mandrel assembly by tension release means;

d. a ratchet lock assembly disposed exteriorly of said support sleeve assembly;

e. a retrieving grapple assembly disposed exteriorly of said support sleeve assembly beneath said ratchet lock assembly;

f. means connecting said retrieving grapple assembly to said ratchet lock assembly;

g. radially disposed support sleeve assembly slot means extending longitudinally of said ssembly:

h. ratchet means on said support sleeve assembly and extending longitudinally thereof and cooperating with said ratchet lock assembly to provide one way upwardly ratcheting movement of said ratchet lock assembly on said support sleeve assembly;

i. cross link means disposed in said cross link assembly and connecting said cross link mandrel to said ratchet lock assembly for transmitting "pull" force to said retrieving grapple assembly via said ratchet lock assembly;

j. torque link means disposed in said tension mandrel assembly and engageable with said support sleeve assembly slot means for transmitting torqueing force from said tension mandrel assembly to said support sleeve assembly;

k. said retrieving grapple assembly including grapple means adapted for engaging the retrieving neck of the packer to be retrieved and also adapted for torqueing engagement with said means connecting said retrieving grapple assembly to said ratchet lock assembly so as to provide for disengagement of said grapple means from said retrieving neck by application of torqueing force to said grapple means.

10. The apparatus of claim 9 wherein said means connecting said retrieving grapple assembly to said ratchet lock assembly comprises:

a. safety release means adapted for receiving said "pull" force and permitting separation of said ratchet lock assembly from said retrieving grapple assembly upon application of "pull" force in excess of a predetermined magnitude; and, b. secondary fishing neck means extending upwardly beyond and interiorly of said safety release means, so as to be exposed upon separation of said ratchet lock assembly from said retrieving grapple assembly.

11. The apparatus of claim 10 wherein means are provided to assure that there is a gap between the lower surface of said centering shoe means and said upper end surface of said packer initially when said packer retrieving tool is set down on said packer and prior to actuation of said setting tool, so as to accomodate a range of inner diameters for casing in which said packer is set.

12. The apparatus of claim 11 wherein said grapple ring means ratchet means includes threads of "hand" opposite to that of other threads on said packer retrieving tool that are subject to said torqueing action.

13. The apparatus of claim 10 wherein said grapple ring means ratchet means includes threads of "hand" opposite to that of other threads on said packer retrieving tool that are subject to said torqueing action.

14. The apparatus of claim 9 wherein means are provided to assure that there is a gap between the lower surface of said centering shoe means and said upper end surface of said packer initially when said packer retrieving tool is set down on said packer and prior to actuation of said setting tool, so as to accomodate a range of inner diameters for casing in which said packer is set.

15. The apparatus of claim 14 wherein said grapple ring means ratchet means includes threads of "hand" opposite to that of other threads on said packer retrieving tool that are subject to said torqueing action.

16. The apparatus of claim 9 wherein said grapple ring means ratchet means includes threads of "hand" opposite to that of other threads on said packer retrieving tool that are subject to said torqueing action.

* * * * *